US007780799B2

(12) United States Patent
Goto et al.

(10) Patent No.: US 7,780,799 B2
(45) Date of Patent: Aug. 24, 2010

(54) COLD-ROLLED STEEL SHEET HAVING A TENSILE STRENGTH OF 780 MPA OR MORE, AN EXCELLENT LOCAL FORMABILITY AND A SUPPRESSED INCREASE IN WELD HARDNESS

(75) Inventors: Koichi Goto, Tokai (JP); Riki Okamoto, Tokai (JP); Hirokazu Taniguchi, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 337 days.

(21) Appl. No.: 10/557,263

(22) PCT Filed: Jan. 9, 2004

(86) PCT No.: PCT/JP2004/000126

§ 371 (c)(1),
(2), (4) Date: Nov. 17, 2005

(87) PCT Pub. No.: WO2004/104256

PCT Pub. Date: Dec. 2, 2004

(65) Prior Publication Data

US 2007/0071997 A1 Mar. 29, 2007

(30) Foreign Application Priority Data

May 21, 2003 (JP) ..... 2003-143638

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl. ..... 148/337; 420/120; 420/128

(58) Field of Classification Search ..... 420/120, 420/128; 148/337

See application file for complete search history.

(56) References Cited

U.S. PATENT DOCUMENTS

| | | | | |
|---|---|---|---|---|
| 4,501,626 | A | 2/1985 | Sudo et al. | |
| 6,364,968 | B1 * | 4/2002 | Yasuhara et al. | 148/320 |
| 6,517,955 | B1 * | 2/2003 | Takada et al. | 428/659 |
| 6,638,371 | B1 * | 10/2003 | Mochida et al. | 148/320 |
| 6,797,410 | B2 * | 9/2004 | Ishii et al. | 428/659 |
| 2007/0131320 | A1 * | 6/2007 | Okamoto et al. | 148/602 |
| 2008/0000555 | A1 * | 1/2008 | Nonaka et al. | 148/328 |
| 2008/0202645 | A1 * | 8/2008 | Kawano et al. | 148/546 |

FOREIGN PATENT DOCUMENTS

| | | | |
|---|---|---|---|
| EP | 922777 | A1 * | 6/1999 |
| EP | 1 028 167 | | 8/2000 |
| EP | 1 201 780 | | 5/2002 |
| EP | 1 207 213 | | 5/2002 |
| JP | 60-224717 | | 11/1985 |
| JP | 03-264645 | | 11/1991 |
| JP | 2001342543 | A * | 12/2001 |
| JP | 2002212674 | | 7/2002 |
| JP | 2003003240 | | 1/2003 |
| JP | 2003247045 | A * | 9/2003 |
| JP | 2003266123 | A * | 9/2003 |
| WO | WO 03/010351 | | 2/2003 |
| WO | WO 03031669 | A1 * | 4/2003 |

OTHER PUBLICATIONS

Machine translation of JP 2001342543 published Dec. 2001.*

* cited by examiner

*Primary Examiner*—George Wyszomierski
*Assistant Examiner*—Tima M McGuthry-Banks
(74) *Attorney, Agent, or Firm*—Kenyon & Kenyon LLP

(57) ABSTRACT

The present invention provides a high-strength cold-rolled steel sheet and a high-strength surface treated steel sheet 780 MPa or more in tensile strength, said steel sheets having excellent local formability and suppressed weld hardness increase and being characterized by: said steel sheets containing, in weight, C: 0.05 to 0.09%, Si: 0.4 to 1.3%, Mn: 2.5 to 3.2%, P: 0.001 to 0.05%, N: 0.0005 to 0.006%, Al: 0.005 to 0.1%, Ti: 0.001 to 0.045%, and S in the range stipulated by the following expression (A), with the balance consisting of Fe and unavoidable impurities; the microstructures of said steel sheets being composed of bainite of 7% or more in terms of area percentage and the balance consisting of one or more of ferrite, martensite, tempered martensite and retained austenite; and said components in said steel sheets satisfying the following expressions (C) and (D) when Mneq. is defined by the following expression (B); $S \leqq 0.08 \times (Ti(\%) - 3.43 \times N(\%) + 0.004$ . . . (A), where, when a value of the member $Ti(\%) - 3.43 \times N(\%)$ of said expression (A) is negative, the value is regarded as zero. $Mneq. = Mn(\%) - 0.29 \times Si(\%) + 6.24 \times C(\%)$ . . . (B), $950 \leqq (Mneq./(C(\%) - (Si(\%)/75))) \times$bainite area percentage (%) . . . (C), $C(\%) + (Si(\%)/20) + (Mn(\%)/18)^5$ 0.30 . . . (D).

3 Claims, 2 Drawing Sheets

COLD-ROLLED STEEL SHEET HAVING A TENSILE STRENGTH OF 780 MPA OR MORE, AN EXCELLENT LOCAL FORMABILITY AND A SUPPRESSED INCREASE IN WELD HARDNESS

TECHNICAL FIELD

The present invention relates to a high-strength cold-rolled steel sheet and a high-strength surface treated steel sheet 780 MPa or more in tensile strength, the steel sheets having excellent local formability and a suppressed weld hardness increase.

BACKGROUND ART

Up to now, steel sheets 590 MPa or less in tensile strength standard have generally been used for parts mostly composing the body of an automobile or a motorcycle.

In recent years, studies have been conducted for enhancing a material strength to a large extent and the application of further enhanced high-strength steel sheets is being attempted with the aim of the reduction of a car body weight for the improvement of fuel efficiency and the improvement of collision safety.

High-strength steel sheets produced for the fulfillment of the aforementioned objects are mostly used for car body frame members and reinforcement members, seat frame parts and others of an automobile or a motorcycle and a steel sheet 780 MPa or more in tensile strength of the base steel having excellent formability is strongly in demand.

Such parts are subjected to working such as press forming and roll forming. However, due to requirements from car body designers and other industrial designers, it is sometimes difficult to drastically change the shapes of such parts from the shapes to which a conventional steel sheet 590 MPa or less in tensile strength is applicable and therefore, for facilitating the forming of a complicated shape, a high-strength steel sheet having excellent workability is required.

In the meantime, working methods are shifting from conventional drawing with a blank holder to simple stamping or bend working in accordance with the adoption of a higher-strength steel sheet. In particular, when a bend ridge curves in the shape of a circular arc or the like, sometimes the ends of a steel sheet are elongated, in other words, stretched flange working is applied. Further, to some parts, burring working wherein a flange is formed by expanding a working hole (lower hole) is often applied. In some large expansion cases, the diameter of the lower hole is expanded up to 1.6 times or more. Meanwhile, an elastic recovery phenomenon after the working of a part, such as spring back, tends to appear as the strength of a steel sheet increases and hinders the accuracy of the part from being secured. For that reason, contrivances, for example to reduce a inner radius for bending up to about 0.5 mm in bend working, are often employed in plastic working methods.

However, in such working, though a steel sheet is required to have local formability such as stretched flange formability, hole expandability, bendability and the like, a conventional high-strength steel sheet is insufficient in securing such formability, and therefore, the problem of a conventional high-strength steel sheet has been that troubles, including cracks, occur and a product cannot be processed stably.

In the meantime, such press-formed parts are very often joined with other parts by spot welding or other welding. However, in the case of a high-strength steel sheet 780 MPa or more in tensile strength in general, a metallurgical method such as the increase of a C-content in steel is often adopted as a means effective for securing strength and the problem caused by the adoption of such a method has been that a weld metal is hardened extremely by heating and cooling at the time of welding and therefore the properties of a weld and the functions of a product are deteriorated.

A hitherto reported high-strength steel sheet having improved the stretched flange formability is the one proposed by Japanese Unexamined Patent Publication No. H9-67645. However, the technology merely improves the stretched flange formability after shearing and does not necessarily improve the properties of a weld.

Further, Japanese Examined Patent Publication Nos. H2-1894 and H5-72460 propose methods for improving weldability of a high-strength steel sheet. The former technology improves the cold-workability and weldability of a high-strength steel sheet. However, with regard to the improvement of cold-workability cited in the technology, the improvement of local formability such as stretched flange formability, hole expandability, bendability and the like is not confirmed sufficiently. In contrast, the latter technology proposes the improvement of stretched flange formability in addition to weldability. However, the strength of a steel sheet included in the invention is at the level of about 550 MPa and the technology is not the one that deals with a high-strength steel sheet 780 MPa or more in tensile strength.

Furthermore, as a result of earnest studies by the present inventors, the following findings have been obtained. In the case of a high-strength steel sheet 780 MPa or more in tensile strength of the base steel, the main strengthening mechanism is actuated mostly by hard martensite and bainite in the second phase and a C content in steel functions as a major factor in the strengthening mechanism. However, as a C content increases, local formability is likely to deteriorate and, at the same time, the hardness of a weld increases conspicuously. Nevertheless, with regard to the aforementioned problems of a high-strength steel sheet 780 MPa or more in tensile strength of the base steel, no proposal focused on the improvement of local formability and the suppression of weld hardening can be found.

DISCLOSURE OF THE INVENTION

The present invention: is the outcome of earnest studies by the present inventors for solving the aforementioned problems; and relates to a high-strength cold-rolled steel sheet and a high-strength surface treated steel sheet 780 MPa or more in tensile strength of the base steels, the steel sheets having excellent local formability such as stretched flange formability, hole expandability, bendability and the like, suppressed weld hardness increase, and moreover good weld properties. The gist of the present invention is as follows:

(1) A high-strength cold-rolled steel sheet and a high-strength surface treated steel sheet 780 MPa or more in tensile strength, said steel sheets having excellent local formability and suppressed weld hardness increase, characterized by: said steel sheets containing, in weight, C: 0.05 to 0.09%,
Si: 0.4 to 1.3%,
Mn: 2.5 to 3.2%,
P: 0.001 to 0.05%,
N: 0.0005 to 0.006%,
Al: 0.005 to 0.1%,
Ti: 0.001 to 0.045%, and S in the range stipulated by the following expression (A), with the balance consisting of Fe and unavoidable impurities; the microstructures of said steel sheets being composed of bainite of 7% or more in terms of area percentage and the balance consisting of one or more of ferrite, martensite, tempered martensite and retained austenite; and said components in said steel sheets satisfying the following expressions (C) and (D) when Mneq. is defined by the following expression (B);

$$S \leqq 0.08 \times (Ti(\%) - 3.43 \times N(\%)) + 0.004 \quad (A),$$

where, when a value of the member Ti(%)−3.43×N(%) of said expression (A) is negative, the value is regarded as zero, $$Mneq. = Mn(\%) - 0.29 \times Si(\%) + 6.24 \times C(\%) \quad (B),$$

$$950 \leqq (Mneq./(C(\%) - (Si(\%)/75))) \times \text{bainite area percentage } (\%) \quad (C),$$

$$C(\%) + (Si(\%)/20) + (Mn(\%)/18) \leqq 0.30 \quad (D).$$

(2) A high-strength cold-rolled steel sheet and a high-strength surface treated steel sheet 780 MPa or more in tensile strength, said steel sheets having excellent local formability and suppressed weld hardness increase according to the item (1), characterized by said steel sheets containing, as additional chemical components, one or more of Nb: 0.001 to 0.04%, B: 0.0002 to 0.0015%, and Mo: 0.05 to 0.50%.

(3) A high-strength cold-rolled steel sheet and a high-strength surface treated steel sheet 780 MPa or more in tensile strength, said steel sheets having excellent local formability and suppressed weld hardness increase according to the item (1) or (2), characterized by said steel sheets containing 0.0003 to 0.01% Ca as a further additional chemical component.

(4) A high-strength cold-rolled steel sheet and a high-strength surface treated steel sheet 780 MPa or more in tensile strength, said steel sheets having excellent local formability and suppressed weld hardness increase according to any one of the items (1) to (3), characterized by said steel sheets containing 0.0002 to 0.01% Mg as a further additional chemical component.

(5) A high-strength cold-rolled steel sheet and a high-strength surface treated steel sheet 780 MPa or more in tensile strength, said steel sheets having excellent local formability and suppressed weld hardness increase according to any one of the items (1) to (4), characterized by said steel sheets containing 0.0002 to 0.01% REM as further additional chemical components.

(6) A high-strength cold-rolled steel sheet and a high-strength surface treated steel sheet 780 MPa or more in tensile strength, said steel sheets having excellent local formability and suppressed weld hardness increase according to any one of the items (1) to (5), characterized by said steel sheets containing 0.2 to 2.0% Cu and 0.05 to 2.0% Ni as further additional chemical components.

(7) A high-strength cold-rolled steel sheet and a high-strength surface treated steel sheet 780 MPa or more in tensile strength, said steel sheets having excellent local formability and suppressed weld hardness increase according to any one of the items (1) to (6), characterized by said surface treated steel sheet being coated with zinc or an alloy thereof as the surface treatment.

BEST MODE FOR CARRYING OUT THE INVENTION

Figure 1:
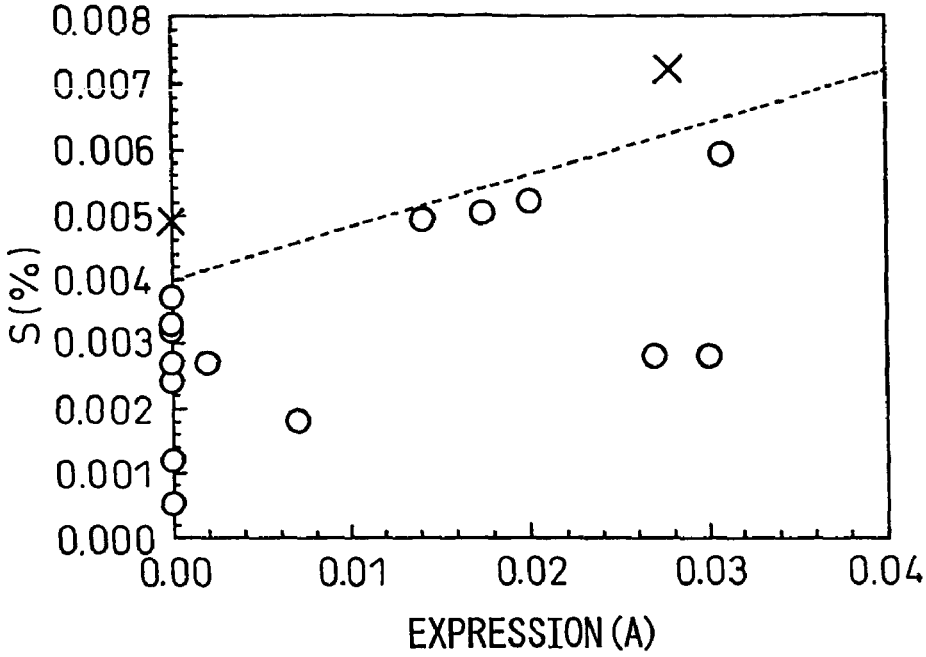
FIG. 1 is a graph showing the influence of a value of the member on the right of the inequality sign in the expression (A) that stipulates the upper limit of an S content and an S content on a local formability index.

The present inventors investigated the steel chemical components and metallographic structures of steel sheets in relation to a means for suppressing weld hardness increase while securing local formability, such as stretched flange formability, hole expandability, bendability and the like, of a steel sheet. Firstly, as a result of the investigation on the local formability of a steel sheet, it has been found that, in the case of a high-strength steel sheet 780 MPa or more in tensile strength of the base steel, press formability, mainly local formability, is determined by the shape of the metallographic structure of the steel sheet and the easiness of the formation of inclusions, such as precipitates and the like, contained therein. Moreover, it has been found that local formability can be improved by: containing C, Si, Mn, P, S, N, Al and Ti; among those components, S, Ti and N that act as factors dominating the formation of sulfide type inclusions satisfying a certain relational expression; and further regulating not only the content range of an individual component such as C but also the relation between a structure advantageous to local formability and plural components including C functioning as the indexes of hardenability.

In the production of a high-strength steel sheet 780 MPa or more in tensile strength, a means of utilizing a hardened structure of martensite, bainite or the like is generally adopted. For example, it is widely known that, in the case of a dual phase complex structure type steel sheet (dual phase steel sheet) excellent in ductility, a large number of movable dislocations are introduced in the vicinity of the interface between a soft ferrite phase and a hard martensite phase formed by quenching and thus a large elongation is obtained. However, a problem of such a steel sheet is that: the structure is microscopically nonuniform due to the coexistence of a soft phase and a hard phase; resultantly the difference in hardness between the phases is large; the interface between the phases cannot withstand local deformation; and cracks are generated. Therefore, for solving the problem, the uniformalization of a structure is effective in the case of a single-phase martensite structure, a bainite structure or a tempered martensite structure. In particular, a bainite structure excellent in balance between strength and ductility shows excellent workability. In the light of the above facts, the present inventors have found that the ease of obtaining a desired bainite structure is strongly affected by C, Si and Mn and local formability is improved when those elements and an actually obtained bainite structure percentage satisfy a certain relational expression.

Further, as a result of studying how to prevent a hardness increase at a weld, it has been found that hardness increase is caused by martensite transformation that occurs with rapid cooling after abrupt local heating at the time of welding and the hardness increase of a weld is suppressed effectively when C and Si and Mn, both affecting hardenability, satisfy a certain relational expression.

The present invention is hereunder explained in detail.

Firstly, the reasons for regulating components in steel are explained hereunder.

C is an element important for enhancing the strength and hardenability of a steel and is essential for obtaining a complex structure composed of ferrite, martensite, bainite, etc. In particular, C of 0.05% or more is necessary for securing a tensile strength of 780 MPa or more and an effective amount of a bainite structure advantageous to local formability. On the other hand, if a C content increases, not only a bainite structure is hardly obtained, iron type carbide such as cementite is likely to coarsen, and resultantly local formability deteriorates but also hardness increases conspicuously after welding and poor welding is caused. For those reasons, the upper limit of a C content is set at 0.09%.

Si is an element favorable for enhancing strength without the workability of a steel being deteriorated. However, when an Si content is less than 0.4%, not only a pearlite structure detrimental to local formability is likely to form but also a hardness difference among formed structures increases due to the decrease of solute strengthening capability of ferrite and therefore local formability deteriorates. For those reasons, the lower limit of an Si content is set at 0.4%. On the other hand, when an Si content exceeds 1.3%, cold-rolling operability deteriorates due to the increase of solute strengthening capability of ferrite and phosphate treatment operability deteriorates due to oxide formed on the surface of a steel sheet. Weldability also deteriorates. For those reasons, the upper limit of an Si content is set at 1.3%.

Mn is an element effective for enhancing the strength and hardenability of a steel and securing a bainite structure favorable for local formability. When an Mn content is less than 2.5%, a desired structure is not obtained. Therefore, the lower limit of an Mn content is set at 2.5%. On the other hand, when an Mn content exceeds 3.2%, the workability of a base steel and also weldability deteriorate. For that reason, the upper limit of an Mn content is set at 3.2%.

A P content of less than 0.001% causes a dephosphorizing cost to increase and therefore the lower limit of a P content is set at 0.001%. On the other hand, when a P content exceeds 0.05%, solidification segregation occurs considerably during casting and thus the generation of internal cracks and the deterioration of workability are caused. Further, the embrittlement of a weld is also caused. For those reasons, the upper limit of a P content is set at 0.05%.

S is an element extremely harmful to local formability since it remains as sulfide type inclusions such as MnS. In particular, the effect of S grows as the strength of a base steel increases. Therefore, when a tensile strength is 780 MPa or more, S should be suppressed to 0.004% or less. However, when Ti is added, the effect of S is alleviated to some extent since Ti precipitates as Ti type sulfide. Therefore, in the present invention, the upper limit of an S content may be regulated by the following relational expression (A) containing Ti and N:

$$S \leqq 0.08 \times (Ti(\%) - 3.43 \times N(\%)) + 0.004 \quad (A),$$

where, when a value of the member $Ti(\%) - 3.43 \times N(\%)$ of the expression (A) is negative, the value is regarded as zero.

Al is an element necessary for the deoxidization of steel. When an Al content is less than 0.005%, deoxidization is insufficient, bubbles remain in a steel and thus defects such as pinholes are generated. Therefore, the lower limit of an Al content is set at 0.005%. On the other hand, when an Al content exceeds 0.1%, inclusions such as alumina increase and the workability of a base steel deteriorates. Therefore, the upper limit of an Al content is set at 0.1%.

With regard to N, an N content of less than 0.0005% causes an increase in steel refining costs. Therefore, the lower limit of an N content is set at 0.0005%. On the other hand, when an N content exceeds 0.006%, the workability of a base steel deteriorates, coarse TiN is likely to be formed with N combining with Ti, and thus local formability deteriorates. In addition, Ti necessary for the formation of Ti type sulfide hardly remains and that is disadvantageous to the alleviation of the upper limit of an S content proposed in the present invention. Therefore, the upper limit of an N content is set at 0.006%.

Ti is an element effective for forming Ti type sulfide that relatively slightly affects local formability and decreases harmful MnS. In addition, Ti has the effect of suppressing the coarsening of a weld metal structure and making the embrittlement thereof hardly occur. Since a Ti content of less than 0.001% is insufficient for exhibiting those effects, the lower limit of a Ti content is set at 0.001%. In contrast, when Ti is added excessively, not only coarse square-shaped TiN increases and thus local formability deteriorates but also stable carbide is formed, thus a C concentration in austenite decreases during the production of a base steel, thus a desired hardened structure is not obtained, and therefore a tensile strength is hardly secured. For those reasons, the upper limit of a Ti content is set at 0.045%.

Nb is an element effective for forming fine carbide that suppresses the softening of a weld heat-affected zone and may be added. However, when an Nb content is less than 0.001%, the effect of suppressing the softening a weld heat-affected zone is not obtained sufficiently. Therefore, the lower limit of an Nb content is set at 0.001%. On the other hand, when Nb is added excessively, the workability of a base steel deteriorates by the increase of carbide. Therefore, the upper limit of an Nb content is set at 0.04%.

B is an element having the effect of improving the hardenability of a steel and suppressing the diffusion of C at a weld heat-affected zone and thus the softening thereof by the interaction with C and may be added. A B addition amount of 0.0002% or more is necessary for exhibiting the effect. On the other hand, when B is added excessively, not only the workability of a base steel deteriorates but also the embrittlement and the deterioration of hot-workability of a steel are caused. For those reasons, the upper limit of a B content is set at 0.0015%.

Mo is an element that facilitates the formation of a desired bainite structure. Further, Mo has the effect of suppressing the softening of a weld heat-affected zone and it is estimated that the effect grows further by the coexistence with Nb or the like. Therefore, Mo is an element beneficial to the improvement of the quality of a weld and may be added. However, an Mo addition amount of less than 0.05% is insufficient for exhibiting the effects and therefore the lower limit thereof is set at 0.05%. In contrast, even when Mo is added excessively, the effects are saturated and that causes an economic disadvantage. Therefore, the upper limit of an Mo content is set at 0.50%.

Ca has the effect of improving the local formability of a base steel by the shape control (spheroidizing) of sulfide type inclusions and may be added. However, a Ca addition amount of less than 0.0003% is insufficient for exhibiting the effect. Therefore, the lower limit of a Ca content is set at 0.0003%. On the other hand, even when Ca is added excessively, not only is the effect saturated but also an adverse effect (the deterioration of local formability) grows by the increase of inclusions. Therefore, the upper limit of a Ca content is set at 0.01%. It is desirable that a Ca content is 0.0007% or more for a better effect.

Mg, when it is added, forms oxide by combining with oxygen and it is estimated that MgO thus formed or complex oxide of $Al_2O_3$, $SiO_2$, MnO, $Ti_2O_3$, etc. containing MgO precipitates very finely. Though it is not confirmed sufficiently, it is estimated that the size of each precipitate is small and therefore statistically the precipitates are distributing in the state of dispersing uniformly. It is further estimated, though it is not obvious, that such an oxide dispersed finely and uniformly in steel forms fine voids at a punch plane or a shear plane from which cracks are originated during punching or shearing, suppresses stress concentration during subsequent burring working or stretched flange working, and by so doing has the effect of preventing the fine voids from growing to coarse cracks. Therefore, Mg may be added for improving hole expandability and stretched flange formability. However, an Mg addition amount of less than 0.0002% is insufficient for exhibiting the effects and therefore the lower limit thereof is set at 0.0002%. On the other hand, When an Mg addition amount exceeds 0.01%, not only the improvement effect in proportion to the addition amount is not obtained any more but also the cleanliness of steel is deteriorated and hole expandability and elongated flange formability are deteriorated. For those reasons, the upper limit of an Mg content is set at 0.01%.

REM are thought to be elements that have the same effects as Mg. Though it is not confirmed sufficiently, it is estimated that REM are elements that can be expected to improve hole expandability and elongated flange formability by the effect of the suppression of cracks due to the formation of fine oxide and thus REM may be added. However, when a REM content is less than 0.0002%, the effects are insufficient and therefore the lower limit thereof is set at 0.0002%. On the other hand, when a REM addition amount exceeds 0.01%, not only the improvement effect in proportion to the addition amount is not obtained any more but also the cleanliness of steel is deteriorated and hole expandability and stretched flange formability are deteriorated. For those reasons, the upper limit of a REM content is set at 0.01%.

Cu is an element effective for improving the corrosion resistance and fatigue strength of a base steel and may be added as desired. However, when a Cu addition amount is less than 0.2%, the effects of improving corrosion resistance and fatigue strength are not obtained sufficiently and, therefore, the lower limit thereof is set at 0.2%. On the other hand, an excessive Cu addition causes the effects to be saturated and a cost to increase and therefore the upper limit thereof is set at 2.0%.

In a Cu added steel, surface defects, called Cu scabs, caused by hot shortness sometimes form during hot rolling. Ni addition is effective in the prevention of Cu scabs and an addition amount of Ni is set at 0.05% or more in the case of Cu addition. On the other hand, an excessive addition of Ni causes the effect to be saturated and a cost to increase. Therefore, the upper limit of an Ni content is set at 2.0%. Here, the effect of Ni addition shows up in proportion to a Cu addition amount and therefore it is desirable that an Ni addition amount be in the range from 0.25 to 0.60 in terms of the ratio Ni/Cu in weight.

The present inventors, with regard to high-strength cold-rolled steel sheets having various chemical components, carried out hole expansion tests which results were regarded as a typical index of local formability, and investigated the relationship between the expression (A) that regulated an upper limit of an S content and a S content. The results are shown in FIG. 1. An excellent local formability is obtained when an S content is in the range regulated by the expression (A). In FIG. 1, ○ represents hole expansion ratio of more than 60%, and x represents hole expansion ratio of less than 60%. It is understood from the figure that, when the addition amounts of S, Ti and N are in the ranges regulated by the present invention, a hole expansion ratio is 60% or more and local formability is excellent.

The above fact: shows that the upper limit of an S content is alleviated to some extent by the formation of Ti type sulfide for suppressing the influence of MnS that hinders local formability; is a proposal different from a hitherto proposed method wherein local formability is improved by merely decreasing an S amount; and is reasonable also from the viewpoint of alleviating cost increase due to the increase of a desulfurizing cost.

Further, in the present invention, an area percentage of a bainite structure and the amounts of C, Si and Mn must satisfy the following relational expression (C):

$$Mneq.=Mn(\%)-0.29\times Si(\%)+6.24\times C(\%) \quad (B),$$

$$950\leqq(Mneq./(C(\%)-(Si(\%)/75)))\times \text{bainite area percentage } (\%) \quad (C).$$

Figure 2:
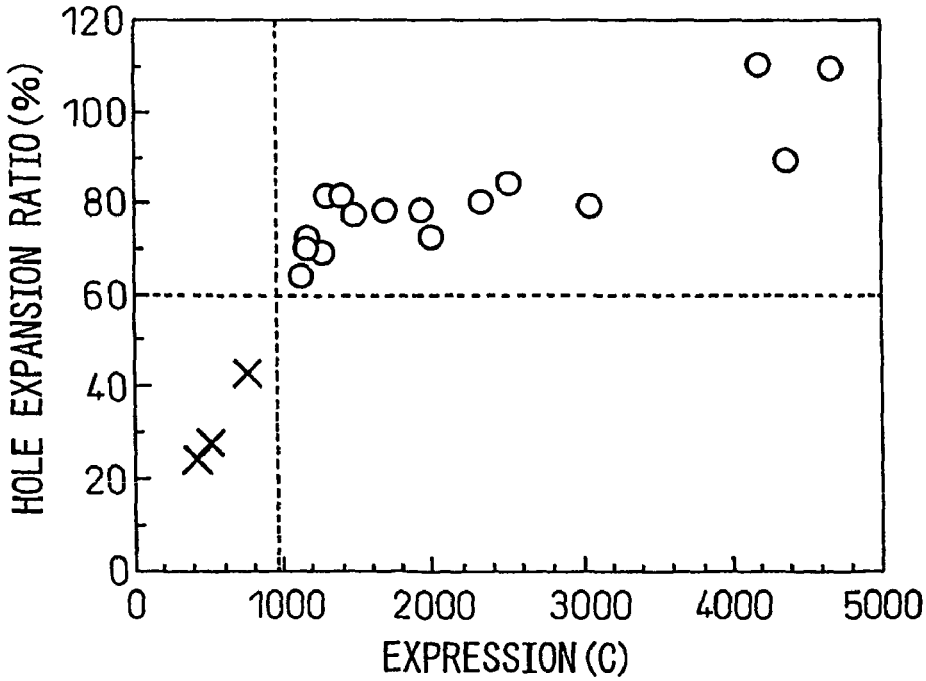
FIG. 2 is a graph showing the relationship between a value of the member on the right of the inequality sign in the expression (C) and a hole expansion ratio as a local formability index.

The present inventors investigated the relationship between a value of the right side member of the above relational expression (C) and a hole expansion ratio functioning as an index of local formability through above-mentioned experiments. The results are shown in FIG. 2. In FIG. 2, ○ represents hole expansion ratio of more than 60%, and x represents hole expansion ratio of less than 60%. It can be understood from the figure that, when the state of a formed microstructure and the amounts of C, Si and Mn satisfy the relational expression, a hole expansion ratio is 60% or more and local formability is excellent.

The above fact shows that, when a value related to not only the amount of a bainite structure advantageous to local formability but also hardening elements, such as C, Si and Mn, that most influence the formation of the structure is less than the value of the left side member, a sufficient local formability is not obtained.

In the meantime, in the present invention, the amounts of C, Si and Mn must also satisfy the following relational expression (D):

$$C(\%)+(Si(\%)/20)+(Mn(\%)/18)\leqq 0.30 \quad (D).$$

Figure 3:
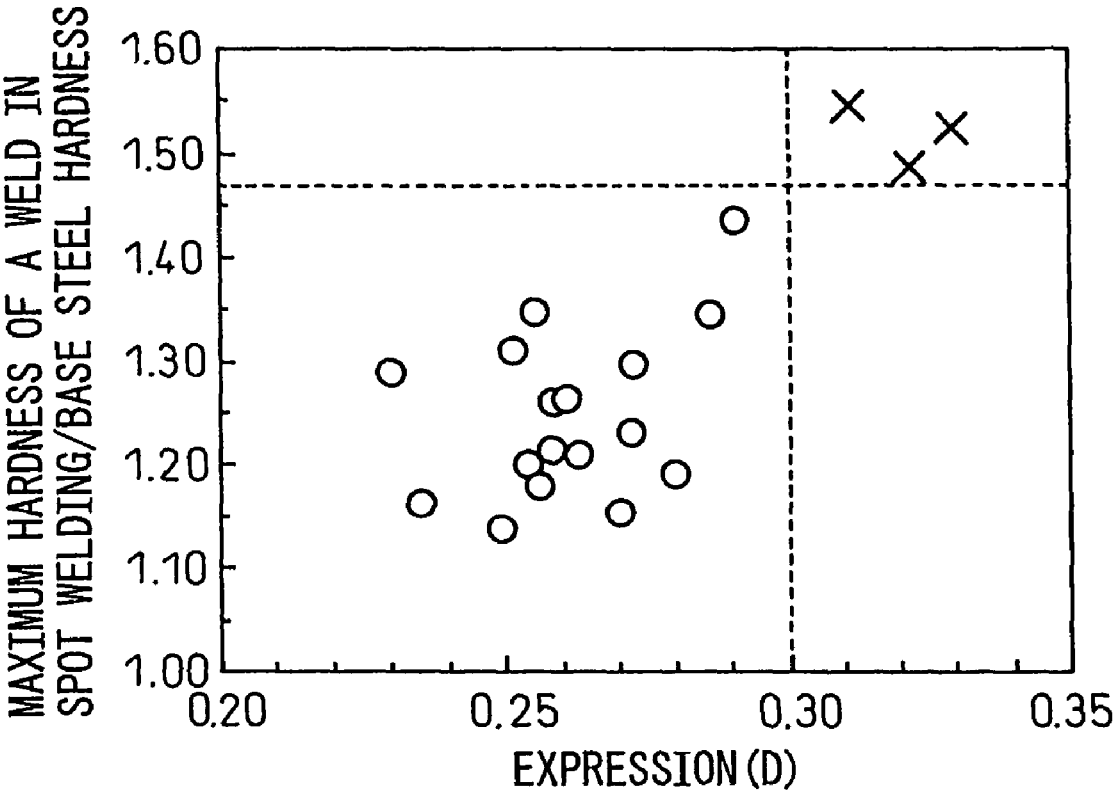
FIG. 3 is a graph showing the influence of a value of the member on the left of the inequality sign in the expression (D) on weld hardness increase.

The present inventors investigated the relationship between a value obtained by the above expression (D) and the maximum hardness of a weld in spot welding and a fracture shape in the tensile test of the weld through aforementioned experiments. The results are shown in FIG. 3. The horizontal axis represents a value computed from the left side member of the expression (D) and the vertical axis represents a ratio of the maximum hardness of a weld in spot welding to the hardness of a base steel (weld-base steel hardness ratio K), each hardness being measured in terms of Vickers hardness (load: 100 gf) at a portion one-fourth of the sheet thickness on the surface of a section. In FIG. 3, ○ represents weld-base steel hardness ratio K of less than 1.47, and x represents weld-base steel hardness ratio K of more than 1.47. It is understood from the figure that, when the addition amounts of C, Si and Mn are in the range regulated by the present invention, the increased hardness of a weld is suppressed to not more than 1.47 times the hardness of a base steel. Whereas fracture occurred in a weld nugget when the ratio exceeded 1.47, fracture occurred outside a weld nugget and thus weldability was good when the ratio was not more than 1.47.

The aforementioned relational expression (D) stipulates a component range in which the hardness of martensite formed through quenching during the heating and rapid cooling of a weld is suppressed.

Further, auxiliary components, such as Cr, V, etc., inevitably included in a steel sheet are not harmful at all to the properties of a steel according to the present invention. However, an excessive addition of the components may cause a recrystallization temperature to rise, rolling operability to deteriorate, and also the workability of a base steel to deteriorate. For that reason, with regard to those auxiliary components, it is desirable to regulate Cr to 0.1% or less and V to 0.01% or less.

A method for producing a high-strength cold-rolled steel sheet and a high-strength surface treated steel sheet according to the present invention may be properly selected in consideration of the application and required properties.

In the present invention, the aforementioned components constitute the basis of a steel according to the present invention. When a bainite area percentage is less than 7% in a microstructure of a base steel, local formability hardly improves. Therefore, the lower limit of a bainite area percentage is set at 7%. A preferable bainite area percentage is 25% or more. An upper limit of a bainite area percentage is not particularly set. However, when it exceeds 90%, the ductility of a base steel is deteriorated by the increase of a hard phase and applicable press parts are largely limited. Therefore, a preferable upper limit of a bainite area percentage is set at 90%. Meanwhile, the influence of another microstructure on the workability of a base steel must be taken into consideration and, to secure a balance between workability and ductility, a preferable ferrite area percentage is 4% or more.

A steel adjusted so as to contain the aforementioned components is processed by the following method for example and steel sheets are produced. Firstly, a steel is melted and refined in a converter and cast into slabs through a continuous casting process. The resulting slabs are inserted in a reheating furnace in the state of a high temperature or after they are cooled to room temperature, heated in the temperature range from 1,150° C. to 1,250° C., thereafter subjected to finish rolling in the temperature range from 800° C. to 950° C., and coiled at a temperature of 700° C. or lower, and resultantly hot-rolled steel sheets are produced. When a finishing temperature is lower than 800° C., crystal grains are in the state of mixed grains and thus the workability of a base steel is deteriorated. On the other hand, when a finishing temperature exceeds 950° C., austenite grains coarsen and thus a desired microstructure is hardly obtained. A coiling temperature of 700° C. or lower is acceptable. However, at a lower temperature, the formation of a pearlite structure tends to be suppressed and a microstructure stipulated in the present invention tends to be obtainable. Therefore, a preferable coiling temperature is 600° C. or lower.

Subsequently, the hot-rolled steel sheets are subjected to pickling, cold rolling and thereafter annealing, and resultantly cold-rolled steel sheets are produced. Though a cold-rolling reduction ratio is not particularly stipulated, an industrially preferable range thereof is from 20 to 80%. An annealing temperature is important for securing the prescribed strength and workability of a high-strength steel sheet and a preferable range thereof is from 700° C. to lower than 900° C. When an annealing temperature is lower than 700° C., recrystallization occurs insufficiently and a stable workability of a base steel itself is hardly obtained. On the other hand, when an annealing temperature is 900° C. or higher, austenite grains coarsen and a desired microstructure is hardly obtained. Further, a continuous annealing process is preferable for obtaining a microstructure stipulated in the present invention. In the case of a high-strength surface treated steel sheet, electroplating is applied to a cold-rolled steel sheet produced through above processes under the condition where the steel sheet is not heated to 200° C. or higher.

For example, in the case of applying an electro-galvanizing, a coating amount of 3 $mg/m^2$ to 80 $g/m^2$ is applied to the surface of a steel sheet. When a coating amount is less than 3 $mg/m^2$, the rust prevention function of the coating is insufficient and thus the object of galvanizing is not fulfilled. On the other hand, when a coating amount exceeds 80 $g/m^2$, an economic efficiency is hindered and defects such as blowholes tend to occur considerably at the time of welding. For those reasons, the preferable coating amount range is the aforementioned range.

Further, even in the case of applying an organic or inorganic film to the surface of a cold-rolled steel sheet or an electroplated layer, the effects of the present invention are not hindered. Note that, in this case too, a temperature of a steel sheet should not exceed 200° C.

In this way, obtained are a high-strength cold-rolled steel sheet and a high-strength surface treated steel sheet 780 MPa or more in tensile strength, the steel sheets having excellent local formability and suppressed weld hardness increase.

EXAMPLES

Steels containing chemical components shown in Table 1 were melted and refined in a converter and cast into slabs through a continuous casting process. Thereafter, resulting slabs were heated to 1,200° C. to 1,240° C., then subjected to hot rolling at a finishing temperature in the range from 880° C. to 920° C. (sheet thickness: 2.3 mm) and coiled at a temperature of 550° C. or lower. Subsequently, the resulting hot-rolled steel sheets were subjected to cold rolling (sheet thickness: 1.2 mm), heated properly to a prescribed temperature in the range from 750° C. to 880° C. in a continuous annealing process, thereafter subjected properly to slow cooling to a prescribed temperature in the range from 700° C. to 550° C., and subsequently cooled further.

The high-strength cold-rolled steel sheets produced through the aforementioned experiments were subjected to tensile tests in the rolling direction and the direction perpendicular to the rolling direction by using JIS #5 test specimens. Thereafter, hole expansion ratios were measured in accordance with the hole expansion test method stipulated in the Japan Iron and Steel Federation Standards. Further, bainite area percentages were measured on sections in the rolling direction of the steel sheets through the processes of: subjecting the sections to mirror-finishing; subjecting them to corrosion treatment for separation by retained γ etching (Nippon Steel Corporation, Haze: CAMP-ISIJ, vol. 6 (1993), p 1,698); observing microstructures under a magnification of 1,000 with an optical microscope; and applying image processing. A bainite area percentage was defined as the average of the values observed in ten visual fields in consideration of the dispersion.

Further, with regard to those high-strength steel sheets, spot welding was applied to high-strength steel sheets of the same kind and the welds were evaluated. The spot welding was conducted under the conditions of not forming weld spatters by using a dome type chip 6 mm in diameter under a loading pressure of 400 kg and a nugget diameter of more than four times the square root of the sheet thickness. A weld was evaluated by a shearing tensile test.

With regard to the increase of hardness at a weld, the hardness was measured with a Vickers hardness meter (measuring load: 100 gf) at the intervals of 0.1 mm at a portion one-fourth of the sheet thickness on the surface of a section containing the weld, the ratio of the maximum hardness of the weld to the hardness of a base steel was measured, and thus the soundness of the weld was evaluated. The results are shown in Table 2.

It can be understood from the table that the invention steels are excellent in local formability and suppressed weld hardness increase in comparison with the comparative steels.

TABLE 1

| Steel code | Steel chemical components (weight %) C | Si | Mn | P | S | AL | N | Ti | Other chemical components | Expression A | Expression B | Expression D | Remarks |
|---|---|---|---|---|---|---|---|---|---|---|---|---|---|
| A | 0.06 | 0.44 | 2.6 | 0.011 | 0.0050 | 0.042 | 0.002 | 0.025 | — | 0.0054 | 2.89 | 0.23 | Invention steel |
| B | 0.05 | 1.25 | 2.9 | 0.015 | 0.0052 | 0.035 | 0.006 | 0.039 | — | 0.0056 | 2.81 | 0.27 | Invention steel |
| C | 0.07 | 0.91 | 3.1 | 0.014 | 0.0005 | 0.042 | 0.005 | 0.006 | — | 0.0040 | 3.24 | 0.29 | Invention steel |
| D | 0.09 | 0.47 | 2.6 | 0.010 | 0.0024 | 0.037 | 0.003 | 0.001 | — | 0.0040 | 3.01 | 0.25 | Invention steel |
| E | 0.05 | 1.16 | 2.9 | 0.009 | 0.0049 | 0.028 | 0.004 | 0.029 | — | 0.0051 | 2.86 | 0.27 | Invention steel |
| F | 0.06 | 0.51 | 2.7 | 0.007 | 0.0037 | 0.036 | 0.005 | 0.018 | — | 0.0040 | 2.90 | 0.24 | Invention steel |
| G | 0.06 | 0.55 | 2.9 | 0.007 | 0.0028 | 0.057 | 0.002 | 0.038 | — | 0.0064 | 3.11 | 0.25 | Invention steel |
| H | 0.09 | 0.43 | 3.1 | 0.008 | 0.0027 | 0.029 | 0.002 | 0.003 | — | 0.0040 | 3.49 | 0.28 | Invention steel |
| I | 0.09 | 0.60 | 3.1 | 0.012 | 0.0028 | 0.094 | 0.004 | 0.041 | — | 0.0062 | 3.49 | 0.29 | Invention steel |
| J | 0.08 | 0.56 | 2.6 | 0.022 | 0.0059 | 0.038 | 0.002 | 0.039 | — | 0.0065 | 3.00 | 0.26 | Invention steel |
| K | 0.05 | 1.14 | 2.7 | 0.047 | 0.0018 | 0.034 | 0.002 | 0.015 | — | 0.0046 | 2.68 | 0.26 | Invention steel |
| L | 0.05 | 1.09 | 3.0 | 0.012 | 0.0027 | 0.044 | 0.004 | 0.015 | B: 0.0007 | 0.0042 | 2.97 | 0.27 | Invention steel |
| M | 0.09 | 0.45 | 2.7 | 0.011 | 0.0032 | 0.037 | 0.003 | 0.004 | Nb: 0.012 | 0.0040 | 3.06 | 0.26 | Invention steel |
| N | 0.08 | 0.72 | 2.7 | 0.010 | 0.0033 | 0.045 | 0.003 | 0.009 | Mo: 0.201 | 0.0040 | 2.93 | 0.26 | Invention steel |
| O | 0.07 | 0.77 | 2.8 | 0.008 | 0.0012 | 0.047 | 0.002 | 0.006 | Ca: 0.0012 REM: 0.0028 | 0.0040 | 2.93 | 0.26 | Invention steel |
| P | 0.08 | 0.57 | 2.8 | 0.009 | 0.0032 | 0.041 | 0.005 | 0.001 | Mg: 0.0022 | 0.0040 | 3.16 | 0.26 | Invention steel |
| Q | 0.09 | 0.40 | 2.6 | 0.015 | 0.0033 | 0.035 | 0.003 | 0.005 | Cu: 0.46 Ni: 0.24 | 0.0040 | 3.04 | 0.25 | Invention steel |
| a | 0.14 | 0.58 | 2.7 | 0.015 | 0.0033 | 0.035 | 0.003 | 0.005 | | 0.0040 | 3.41 | 0.32 | Comparative steel |
| b | 0.07 | 0.22 | 2.7 | 0.012 | 0.0028 | 0.030 | 0.001 | 0.047 | — | 0.0074 | 3.10 | 0.24 | Comparative steel |
| c | 0.09 | 1.45 | 2.7 | 0.015 | 0.0032 | 0.040 | 0.004 | 0.001 | — | 0.0040 | 2.84 | 0.11 | Comparative steel |
| d | 0.04 | 0.38 | 2.6 | 0.015 | 0.0019 | 0.038 | 0.006 | 0.006 | — | 0.0040 | 2.77 | 0.21 | Comparative steel |
| e | 0.07 | 0.85 | 2.6 | 0.008 | 0.0049 | 0.039 | 0.002 | 0.008 | — | 0.0040 | 2.71 | 0.25 | Comparative steel |
| f | 0.11 | 0.85 | 3.2 | 0.008 | 0.0033 | 0.036 | 0.004 | 0.009 | — | 0.0040 | 3.62 | 0.33 | Comparative steel |
| g | 0.08 | 0.51 | 2.8 | 0.009 | 0.0029 | 0.042 | 0.004 | 0.042 | — | 0.0069 | 3.15 | 0.26 | Comparative steel |
| h | 0.08 | 0.77 | 2.6 | 0.009 | 0.0072 | 0.042 | 0.002 | 0.033 | — | 0.0062 | 2.89 | 0.26 | Comparative steel |

*1) The numbers in the shaded boxes are outside the ranges stipulated in the present invention.

TABLE 2

| Steel code | Bainite (%) | Expression A | Expression B | Expression D | Expression C | Tensile strength (MPa) | Hole expansion ratio λ (%) |
|---|---|---|---|---|---|---|---|
| A | 39 | 0.0054 | 2.89 | 0.23 | 2007 | 962 | 72 |
| B | 73 | 0.0056 | 2.81 | 0.27 | 5810 | 954 | 92 |
| C | 76 | 0.0040 | 3.24 | 0.29 | 4182 | 1017 | 110 |
| D | 31 | 0.0040 | 3.01 | 0.25 | 1187 | 1088 | 72 |
| E | 40 | 0.0051 | 2.86 | 0.27 | 3053 | 995 | 79 |
| F | 37 | 0.0040 | 2.90 | 0.24 | 1943 | 1054 | 78 |
| G | 41 | 0.0064 | 3.11 | 0.25 | 2331 | 1077 | 80 |
| H | 35 | 0.0040 | 3.49 | 0.28 | 1487 | 1124 | 77 |
| I | 39 | 0.0062 | 3.49 | 0.29 | 1699 | 941 | 78 |
| J | 29 | 0.0065 | 3.00 | 0.26 | 1137 | 942 | 64 |
| K | 64 | 0.0046 | 2.68 | 0.26 | 4668 | 824 | 109 |
| L | 58 | 0.0042 | 2.97 | 0.27 | 4366 | 1005 | 89 |
| M | 33 | 0.0040 | 3.06 | 0.26 | 1278 | 993 | 69 |
| N | 30 | 0.0040 | 2.93 | 0.26 | 1305 | 1005 | 81 |

TABLE 2-continued

| | | | | | | | |
|---|---|---|---|---|---|---|---|
| O | 47 | 0.0040 | 2.93 | 0.26 | 2518 | 1065 | 84 |
| P | 31 | 0.0040 | 3.16 | 0.26 | 1409 | 1086 | 81 |
| Q | 31 | 0.0040 | 3.04 | 0.25 | 1169 | 912 | 70 |
| a | 20 | 0.0040 | 3.41 | 0.32 | 501 | 1206 | 28 |
| b | 17 | 0.0074 | 3.10 | 0.24 | 741 | 999 | 57 |
| c | 18 | 0.0040 | 2.84 | 0.31 | 756 | 964 | 43 |
| d | 6 | 0.0040 | 2.77 | 0.21 | 426 | 694 | 88 |
| e | 15 | 0.0040 | 2.71 | 0.25 | 757 | 1025 | 40 |
| f | 13 | 0.0040 | 3.62 | 0.33 | 477 | 1109 | 24 |
| g | 47 | 0.0069 | 3.15 | 0.26 | 1915 | 1101 | 41 |
| h | 34 | 0.0062 | 2.99 | 0.26 | 1429 | 997 | 41 |

| Steel code | Local formability judgment: λ ≧ 60% | Base steel hardness (Hv0.1) | Maximum weld hardness (Hv0.1) | Weld-base steel hardness ratio K (K = maximum weld hardness/ base steel hardness) | Weldability judgment: K ≦ 1.47 | Fracture shape of spot weld | Remarks |
|---|---|---|---|---|---|---|---|
| A | ○ | 289 | 372 | 1.29 | ○ | Outside nugget | Invention steel |
| B | ○ | 279 | 361 | 1.29 | ○ | Outside nugget | Invention steel |
| C | ○ | 301 | 404 | 1.34 | ○ | Outside nugget | Invention steel |
| D | ○ | 349 | 418 | 1.20 | ○ | Outside nugget | Invention steel |
| E | ○ | 311 | 358 | 1.15 | ○ | Outside nugget | Invention steel |
| F | ○ | 340 | 395 | 1.16 | ○ | Outside nugget | Invention steel |
| G | ○ | 355 | 403 | 1.14 | ○ | Outside nugget | Invention steel |
| H | ○ | 358 | 426 | 1.19 | ○ | Outside nugget | Invention steel |
| I | ○ | 299 | 429 | 1.43 | ○ | Outside nugget | Invention steel |
| J | ○ | 325 | 409 | 1.26 | ○ | Outside nugget | Invention steel |
| K | ○ | 292 | 354 | 1.21 | ○ | Outside nugget | Invention steel |
| L | ○ | 314 | 386 | 1.23 | ○ | Outside nugget | Invention steel |
| M | ○ | 307 | 413 | 1.35 | ○ | Outside nugget | Invention steel |
| N | ○ | 317 | 400 | 1.26 | ○ | Outside nugget | Invention steel |
| O | ○ | 339 | 399 | 1.18 | ○ | Outside nugget | Invention steel |
| P | ○ | 345 | 417 | 1.21 | ○ | Outside nugget | Invention steel |
| Q | ○ | 317 | 415 | 1.31 | ○ | Outside nugget | Invention steel |
| a | X | 335 | 498 | 1.49 | X | Inside nugget | Comparative steel |
| b | X | 320 | 385 | 1.20 | ○ | Inside nugget | Comparative steel |
| c | X | 278 | 429 | 1.54 | X | Inside nugget | Comparative steel |
| d | ○ | 242 | 305 | 1.26 | ○ | Inside nugget | Comparative steel |
| e | X | 331 | 376 | 1.14 | ○ | Inside nugget | Comparative steel |
| f | X | 324 | 478 | 1.40 | X | Inside nugget | Comparative steel |
| g | X | 356 | 407 | 1.14 | ○ | Inside nugget | Comparative steel |
| h | X | 314 | 380 | 1.21 | ○ | Inside nugget | Comparative steel |

*1) The numbers in the shaded boxes are outside the ranges stipulated in the present invention.

*2) Local formability judgment: hole expansion ratio λ ≧ 60% is expressed by the mark ○ (good).

*3) Weldability judgment: the case where a weld-base steel hardness ratio K (= maximum weld hardness/base steel hardness) is 1.47 or less is expressed by the mark ○ (good).

INDUSTRIAL APPLICABILITY

The present invention makes it possible to provide a high-strength cold-rolled steel sheet and a high-strength surface treated steel sheet 780 MPa or more in tensile strength, the steel sheets having excellent local formability and a suppressed weld hardness increase.

The invention claimed is:

1. A high-strength cold-rolled steel sheet 780 MPa or more in tensile strength, said steel sheet having excellent local formability, 60% or more hole expandability and suppressed weld hardness increase, characterized by: consisting of, in weight, C: 0.05 to 0.09%,
Si: 0.4 to 1.3%,
Mn: 2.5 to 3.2%,
P: 0.001 to 0.05%,
N: 0.0005 to 0.004%,
Al: 0.005 to 0.1%,
Ti: 0.001 to 0.045%, and one or more of:

Nb: 0.001 to 0.04%,
B: 0.0002 to 0.0015%,
Mo: 0.05 to 0.50%,
Ca: 0.0003 to 0.01%,
REM: 0.0002 to 0.01% and S in the range stipulated by the following expression (A), with a balance of Fe and unavoidable impurities; the microstructures of said steel sheet being composed of bainite of 7% or more in terms of area percentage and the balance consisting of one or more of ferrite, martensite, tempered martensite and retained austenite; and said components in said steel sheet satisfying the following expressions (C) and (D) when Mneq. is defined by the following expression (B);

$$S \leqq 0.08 \times (Ti(\%) - 3.43 \times N(\%)) + 0.004 \quad (A),$$

where, when a value of the member Ti(%)−3.43×N(%) of said expression (A) is negative, the value is regarded as zero, and S is precipitated as Ti type sulfide, $$Mneq. = Mn(\%) - 0.29 - Si(\%) + 6.24 \times C(\%) \quad (B),$$

$$950 \geqq (Mneq./(C(\%) - (Si(\%)/75))) \times \text{bainite area percentage } (\%) \quad (C),$$

$$C(\%) + (Si(\%)/20) + (Mn(\%)/18) \leqq 0.30 \quad (D).$$

2. A high-strength cold-rolled steel sheet of claim 1, wherein the steel sheet is coated with zinc or zinc alloy.

3. A high-strength cold-rolled steel sheet of claim 1, wherein Mn is present in an amount of 2.6 to 3.2% by weight.

* * * * *

UNITED STATES PATENT AND TRADEMARK OFFICE

CERTIFICATE OF CORRECTION

PATENT NO. : 7,780,799 B2
APPLICATION NO. : 10/557263
DATED : August 24, 2010
INVENTOR(S) : Koichi Goto et al.

It is certified that error appears in the above-identified patent and that said Letters Patent is hereby corrected as shown below:

Column 16, lines 16-17, change "950 ≧ (Mneq./(C(%) - (Si(%)/75))) × bainite area percentage (%) ... (C),"

to -- 950 ≦ (Mneq./(C(%) - (Si(%)/75))) × bainite area percentage (%) ... (C), --;

Signed and Sealed this
Ninth Day of April, 2013

Teresa Stanek Rea
*Acting Director of the United States Patent and Trademark Office*